US008552659B2

(12) United States Patent
Ashdown et al.

(10) Patent No.: US 8,552,659 B2
(45) Date of Patent: Oct. 8, 2013

(54) METHOD AND APPARATUS FOR DISCRIMINATING MODULATED LIGHT IN A MIXED LIGHT SYSTEM

(75) Inventors: Ian Ashdown, West Vancouver (CA); Marc Salsbury, Ottawa (CA)

(73) Assignee: Koninklijke Philips N.V., Eindhoven (NL)

( * ) Notice: Subject to any disclaimer, the term of this patent is extended or adjusted under 35 U.S.C. 154(b) by 222 days.

(21) Appl. No.: 12/671,714

(22) PCT Filed: Aug. 6, 2008

(86) PCT No.: PCT/IB2008/053149

§ 371 (c)(1),
(2), (4) Date: Sep. 7, 2011

(87) PCT Pub. No.: WO2009/019655

PCT Pub. Date: Feb. 12, 2009

(65) Prior Publication Data

US 2011/0309754 A1 Dec. 22, 2011

(30) Foreign Application Priority Data

Aug. 7, 2007 (CA) ..... 2596184

(51) Int. Cl.
*H05B 37/02* (2006.01)

(52) U.S. Cl.
USPC ..... 315/291; 315/312

(58) Field of Classification Search
USPC ..... 315/291, 307, 308, 224, 246, 312, 315/185 R
See application file for complete search history.

(56) References Cited

U.S. PATENT DOCUMENTS

| | | | | |
|---|---|---|---|---|
| 6,016,038 | A | 1/2000 | Mueller et al. | |
| 6,150,774 | A | 11/2000 | Mueller et al. | |
| 6,211,626 | B1 | 4/2001 | Lys et al. | |
| 6,498,440 | B2 * | 12/2002 | Stam et al. | 315/291 |
| 6,963,175 | B2 * | 11/2005 | Archenhold et al. | 315/291 |
| 7,208,713 | B2 * | 4/2007 | Ishiguchi | 250/205 |
| 7,432,668 | B2 * | 10/2008 | Zwanenburg et al. | 315/312 |
| 2006/0006821 | A1 * | 1/2006 | Singer et al. | 315/312 |
| 2007/0040512 | A1 * | 2/2007 | Jungwirth et al. | 315/159 |

FOREIGN PATENT DOCUMENTS

| | | | |
|---|---|---|---|
| EP | 1635617 | A2 | 3/2006 |
| WO | 2004057923 | A1 | 7/2004 |

* cited by examiner

*Primary Examiner* — Minh D A
(74) *Attorney, Agent, or Firm* — Yuliya Mathis

(57) ABSTRACT

Methods and apparatus are disclosed for providing optical emission feedback control for an illumination system comprising mixed light including light from a first light source (135) and a second light source (140). Each light source is driven by a drive current configured using a control and/or modification signal associated with that light source. The control signal in turn can be configured using a modification signal associated with the light source. An optical signal indicative of the mixed light is generated, for example using an optical sensor (150), and the optical signal is processed based on a reference signal to provide measurements indicative of light from each light source, which are used for feedback control of the illumination system. The reference signals can be generated locally or based on a corresponding control or modification signal. To provide measurements for a light source, processing (198) of the optical signal can comprise mixing (235) and compensation (255) operations based on control and/or modification signals associated with that light source.

20 Claims, 13 Drawing Sheets

METHOD AND APPARATUS FOR DISCRIMINATING MODULATED LIGHT IN A MIXED LIGHT SYSTEM

TECHNICAL FIELD

The present invention generally relates to lighting systems. More particularly, various inventive methods and apparatus disclosed herein relate to method and apparatus for discriminating modulated light from different light sources in a mixed-light illumination system, for example to facilitate optical feedback control thereof.

BACKGROUND

Digital lighting technologies, i.e. illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some of the fixtures embodying these sources feature a lighting module, including one or more LEDs capable of producing different colors, e.g. red, green, and blue, as well as a processor for independently controlling the output of the LEDs in order to generate a variety of colors and color-changing lighting effects, for example, as discussed in detail in U.S. Pat. Nos. 6,016,038 and 6,211,626.

It is well-known that by mixing light with different spectra such as red, green, and blue light, it is possible to generate light of different colors. Accordingly, varying the intensity of radiation from different color LEDs, such as the commonly available red, green, and blue LEDs and optionally amber LEDs, can give the perception of an output light of any desired color, including white light.

Aspects of the resultant output light, such as chromaticity, are dependent on the combination of the intensities and center wavelengths of the LEDs combined to produce the output light. These optical parameters can fluctuate even when the LED drive current is constant, due to such factors as heat sink thermal constants, changes in ambient temperature and device aging.

One approach to alleviate this problem is to employ optical feedback to continuously monitor the radiant flux output of the different color LEDs so as to adjust the drive currents of the LEDs such that the luminous flux and chromaticity of the output light remain substantially constant. This monitoring requires some means of measuring the radiant flux output of each LED color.

To date, several optical feedback solutions have been proposed to detect and evaluate the luminous flux and chromaticity of the output light in order to provide for correction if these values deviate from a desired color point. For instance, a number of approaches rely on an array of photosensors, each having a selected color filter responsive to light of a selected color. However, these photosensors are prone to optical crosstalk and suffer from inaccuracies in the measurement of the characteristics of the output light due to the overlap in the spectral radiant power distribution of the light emitted by LEDs of different colors.

A partial solution to this crosstalk problem is to select bandpass filters with narrow bandwidths and steep cutoff characteristics. Although satisfactory performance levels for such filters can be achieved using multilayer interference filters, these filters can be expensive and typically require further optics for collimating the output light, as the bandpass wavelengths are dependent on the incidence angle of the output light upon the filters.

Another problem associated with interference filters is that the center wavelengths of high-flux LEDs are dependent on the LED junction temperature. In addition, the bandpass transmittance spectra of interference filters are also temperature dependent. The output signal of the photosensor is dependent on the convolution of the spectral radiant power distribution of the LED and the bandpass characteristics of the filter. Therefore, the output signal of the photosensor may change with ambient temperature even if the LED spectral radiant power distribution remains constant, which can further limit the performance of an optical feedback system.

In another approach, each LED in a multi-color LED-based lighting system is controlled by an electronic control circuit, which selectively turns OFF the LEDs for the colors not being measured in a sequence of time pulses using a single broadband optical sensor. The average light output during the measuring period can be substantially equal to the nominal continuous light output during the ordinary operation to avoid visible flicker. A difficulty associated with this approach is that color balance is periodically and potentially drastically altered each time the LEDs are de-energized, causing noticeable flicker. Since the optical sensor requires a finite amount of time to measure the radiant flux of the energized LEDs with sufficient accuracy and acceptable signal-to-noise ratio, the sampling frequency can be limited by the response time of the optical sensor. A limited sampling frequency can result in lower sampling resolution and longer response times for the optical feedback loop. Moreover, since the LED colors are to be measured sequentially, this approach for optical data collection can further increase the feedback loop response time by a factor of three for a system with red, green, and blue LED clusters and a factor of four for a system with red, green, blue, and amber LED clusters.

A similar approach seeks to alleviate the flicker by selectively measuring the light output of the LEDs in a sequence of time pulses, whereby the current for the color being measured is turned OFF. Neither of these proposed solutions however, addresses the periodic and potentially drastic changes in the color balance or the reduction in feedback loop response time.

In yet another approach, the light output of the LEDs is sampled by a broadband optical sensor during the duration of the PWM drive pulse where the pulse has reached full magnitude, so as to avoid the effect of the rise and fall times of the PWM pulse. The average drive current is then determined by low pass filtering. A difficulty associated with this approach can be that the PWM pulses must be synchronized such that at least one LED color is de-energized for a finite period of time during the PWM period. This requirement can prevent operation of all different color LEDs at full power at 100% duty factor. Another disadvantage associated with this average light sensing is that the sampling period must provide sufficient time for the optical sensor to reliably measure the radiant flux of the energized LEDs, in addition to a requirement that the LED colors must be measured sequentially, which can limit the feedback loop response time.

Another approach is to provide an apparatus for controlling a light source wherein the light source includes at least one light source that emits light with a superimposed optical signal at a discrete frequency and an electronic reference signal at a discrete frequency. The apparatus includes a photodetector optically coupled to the light source and designed to receive the light signal. The apparatus includes at least one lock-in system coupled to the photodetector and each light source that receives the light signal from the photodetector and receives the reference signal from the light source. Each lock-in system produces an intensity value of the light source based on the light signal and the reference signal. The lock-in system may include a signal multiplier and a filter coupled to the signal multiplier wherein the intensity value is the product of the light signal and the reference signal processed through the signal multiplier, and filtered to remove non-DC portions. While this apparatus can provide for the detection of light contribution, there can be an inherent error that enters this format of a system, thereby limiting the effectiveness thereof for control of light output by the apparatus. Furthermore, this apparatus does not provide for driving LEDs using sophisticated drive techniques, such as pulse-width modulation with a controllable duty cycle.

Thus, there is a need in the art for a new optical feedback method and apparatus that can provide radiant flux output data for a plurality of light sources in a mixed light system using a broadband optical sensor.

SUMMARY OF THE INVENTION

The present disclosure is directed to inventive methods and apparatus for providing optical emission feedback in an illumination system. For example, methods and apparatus are disclosed wherein mixed light is generated comprising light from a first light source and a second light source. Each light source is driven by a drive current configured using a control signal associated with that light source. The control signal, in turn, can be configured using a modification signal associated with the light source. An optical signal indicative of the mixed light is generated, for example using an optical sensor, and the optical signal is processed based on a reference signal to provide measurements indicative of light from each light source. The reference signals can be generated locally or based on a corresponding control or modification signal. The measurements can be used for feedback control of the illumination system. To provide measurements for a given light source, processing of the optical signal comprises filtering based on the time-varying aspects of the light, which can comprise mixing and compensation operations based on a control and/or modification signal associated with that light source.

Generally, in one aspect, there is provided an illumination device for generating light having a desired luminous flux and chromaticity. The illumination device includes one or more first light sources adapted to generate a first light having a first spectral power distribution, and one or more second light sources adapted to generate a second light having a second spectral power distribution different than the first spectral power distribution. The illumination device further includes a first current driver operatively coupled to the one or more first light sources, and a second current driver operatively coupled to the one or more second light sources. The first and second current drivers are configured to selectively supply electrical drive current to the light sources based on first and second control signals, respectively. The illumination device further includes an optical sensor for sensing a portion of an output light which includes a combination of the first light and second light, the optical sensor configured to generate an optical signal indicative of radiant flux of the output light. Also provided is a processing module operatively coupled with the optical sensor and receiving the optical signal therefrom. The processing module includes a first filtering module including a first mixing module. The first mixing module is configured to perform mixing of a first filtered signal indicative of a first portion of the optical signal using a first reference signal. The first filtering module provides a first output signal indicative of a characteristic of a portion of the first light. The processing module also includes a second filtering module including a second mixing module. The second mixing module is configured to perform mixing of a second filtered signal indicative of a second portion of the optical signal using a second reference signal. The second filtering module provides a second output signal indicative of a characteristic of a portion of the second light. The illumination device also includes a controller operatively coupled with the first current driver, second current driver, and the processing module. The controller is configured to generate the first control signal and second control signal based at least in part on the respective first output signal and the second output signal. The first control signal and second control signal are at least in part configured using a first modification signal and second modification signal, respectively.

In one embodiment, the first filtering module further includes a first compensation module configured to provide the first output signal based on at least output of the first mixing module and the first modification signal.

In another aspect, the invention generally focuses on a method for generating output light of a desired luminous flux and chromaticity. The method includes the step of generating a first drive current for one or more first light sources at least in part using a first modification signal. The method further includes the step of generating a second drive current for one or more second light sources at least in part using a second modification signal. The method also includes the step of generating an optical signal indicative of output light characteristics, the output light being a mixture of light emitted by the one or more first light sources and one or more second light sources. The method further includes the step of processing a first portion of the optical signal including performing a first mixing operation based on a first reference signal, thereby providing a first measurement indicative of radiant flux of light emitted by the one or more first light sources. The method further includes the step of processing a second portion of the optical signal including performing a second mixing operation based on a second reference signal, thereby providing a second measurement indicative of radiant flux of light emitted by the one or more second light sources. The method further includes the step of and adjusting the first drive current and the second drive current if required.

In one embodiment of the above aspect of the invention, processing the first portion of the optical signal further includes performing a first compensation operation based on the first modification signal.

In another aspect, the invention contemplates a computer program product including a computer readable medium having recorded thereon statements and instructions for execution by a processor to carry out a method for generating output light of a desired luminous flux and chromaticity. The method includes the steps of generating:

a first drive current for one or more first light sources at least in part using a first modification signal, a second drive current for one or more second light sources at least in part using a second modification signal, and an optical signal indicative of output light characteristics, the output light being a mixture of light emitted by the one or more first light sources and one or more second light sources.

The method further includes the step of processing a first portion of the optical signal including performing a first mixing operation based on a first reference signal, thereby providing a first measurement indicative of radiant flux of light emitted by the one or more first light sources. The method further comprises the step of processing a second portion of the optical signal including performing a second mixing operation based on a second reference signal, thereby providing a second measurement indicative of radiant flux of light emitted by the one or more second light sources. The method may also include the step of and adjusting the first drive current and the second drive current.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyro-luminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "color temperature" generally is used herein in connection with white light, although this usage is not intended to limit the scope of this term. Color temperature essentially refers to a particular color content or shade (e.g., reddish, bluish) of white light. The color temperature of a given radiation sample conventionally is characterized according to the temperature in degrees Kelvin (K) of a black body radiator that radiates essentially the same spectrum as the radiation sample in question. Black body radiator color temperatures generally fall within a range of from approximately 700 degrees K. (typically considered the first visible to the human eye) to over 10,000 degrees K.; white light generally is perceived at color temperatures above 1500-2000 degrees K.

Lower color temperatures generally indicate white light having a more significant red component or a "warmer feel," while higher color temperatures generally indicate white light having a more significant blue component or a "cooler feel." By way of example, fire has a color temperature of approximately 1,800 degrees K., a conventional incandescent bulb has a color temperature of approximately 2848 degrees K., early morning daylight has a color temperature of approximately 3,000 degrees K., and overcast midday skies have a color temperature of approximately 10,000 degrees K. A color image viewed under white light having a color temperature of approximately 3,000 degree K. has a relatively reddish tone, whereas the same color image viewed under white light having a color temperature of approximately 10,000 degrees K. has a relatively bluish tone.

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

The term "addressable" is used herein to refer to a device (e.g., a light source in general, a lighting unit or fixture, a controller or processor associated with one or more light sources or lighting units, other non-lighting related devices, etc.) that is configured to receive information (e.g., data) intended for multiple devices, including itself, and to selectively respond to particular information intended for it. The term "addressable" often is used in connection with a networked environment (or a "network," discussed further below), in which multiple devices are coupled together via some communications medium or media.

In one network implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices coupled to the network each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

The term "network" as used herein refers to any interconnection of two or more devices (including controllers or processors) that facilitates the transport of information (e.g. for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

The term "user interface" as used herein refers to an interface between a human user or operator and one or more devices that enables communication between the user and the device(s). Examples of user interfaces that may be employed in various implementations of the present disclosure include, but are not limited to, switches, potentiometers, buttons, dials, sliders, a mouse, keyboard, keypad, various types of game controllers (e.g., joysticks), track balls, display screens, various types of graphical user interfaces (GUIs), touch screens, microphones and other types of sensors that may receive some form of human-generated stimulus and generate a signal in response thereto.

The term "optical sensor" is used to define an optical device having a measurable sensor parameter in response to a characteristic of incident light, such as its luminous flux output or radiant flux output.

The term "broadband optical sensor" is used to define an optical sensor that is responsive to all wavelengths of light within a wide range of wavelengths, such as the visible spectrum for example.

The term "narrowband optical sensor" is used to define an optical sensor that is responsive to all wavelengths of light within a narrow range of wavelengths, such as the red region of the visible spectrum for example.

The term "chromaticity" is used to define the perceived color impression of light according to standards of the Illuminating Engineering Society of North America.

The term "luminous flux" is used to define the instantaneous quantity of visible light emitted by a light source according to standards of the Illuminating Engineering Society of North America.

The term "spectral radiant flux" is used to define the instantaneous quantity of electromagnetic power emitted by a light source at a specified wavelength according to standards of the Illuminating Engineering Society of North America.

The term "spectral power distribution" is used to define the distribution of spectral radiant flux emitted by a light source over a range of wavelengths, such as the visible spectrum for example. In some embodiments, properties of the spectral power distribution can also be associated with spectrum and color of a light source.

The term "radiant flux" is used to define the sum of spectral radiant flux emitted by a light source over a specified range of wavelengths.

The term "filter" is used herein to refer to a signal processing device wherein a signal is manipulated to remove, enhance, or otherwise alter at least a portion of components of the signal. Examples of filters include passive, active, digital, analog, low-pass, high-pass, band-pass, Butterworth, comb, and other filter designs as would be understood by a worker skilled in the art.

The term "mixing" is used herein to refer to signal processing or filtering methods wherein a time-varying signal is manipulated using one or more reference signals to produce an altered representation of at least a portion of the time-varying signal. For example, mixing can be used to translate or convert the frequency of a periodic or quasi-periodic signal, provide an output, such as a DC signal, indicative of aspects of the time-varying signal, or otherwise manipulate the signal to facilitate extracting information therefrom. The term "mixer" is used herein to refer to a device performing mixing, such as a device comprising a signal multiplier and optionally comprising a local oscillator, phase detector and/or one or more additional filters. Homodyne receivers, heterodyne receivers, lock-in filters or amplifiers and the like are examples of devices comprising mixers.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
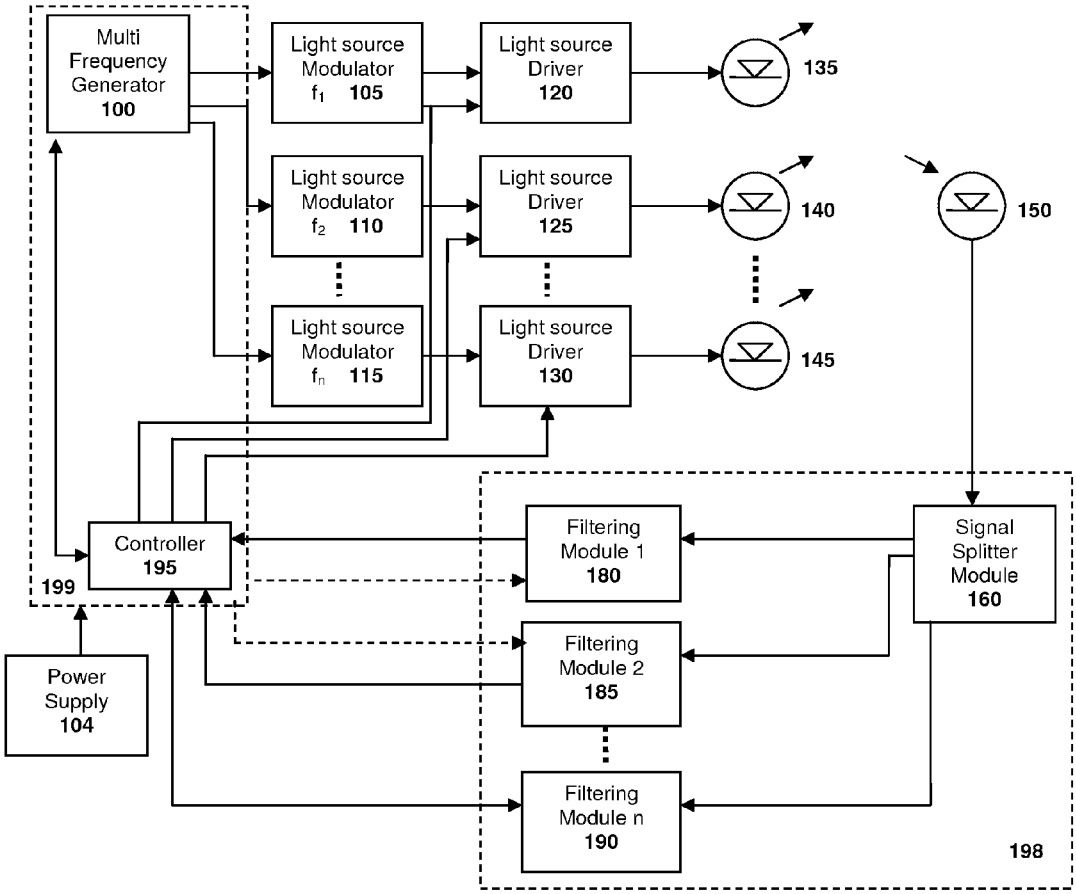
FIG. 1 is a block diagram of an illumination system according to one embodiment of the present invention.

The present invention stems from the realization that the luminous flux output and chromaticity of the output light from a combination of light sources with different colors can be maintained at a desired level by optical feedback to adjust the drive current of the light sources. However, maintaining consistent output light using optical feedback control is difficult to achieve due to limitations such as crosstalk between narrowband optical sensors and low sampling frequency at which light from the light sources is measured. These undesired effects in turn can reduce the response time of the feedback control system and can introduce errors in the amount of radiant flux from different color light sources detected and evaluated.

The present invention seeks to overcome these undesired effects on an optical feedback control system whereby the control signal for each array of one or more light sources corresponding to a particular color, is independently configured to provide drive current having a frequency which is different for each color. A signal processing module is configured to discriminate between the radiant flux corresponding to each of the different colors of light sources, from the sample of the mixed radiant flux output collected by a broadband optical sensor. The signal processing module comprises one or more filtering modules, the output of each filtering module being substantially directly proportional to the radiant flux output of the light sources of an associated color. This information can subsequently be used by the controller together with the desired luminous flux and chromaticity of the output light, in order to generate subsequent control signals for each color of light source arrays.

More generally, Applicants have recognized and appreciated that it would be beneficial to discriminate properties of different color light sources of a mixed light, based on observing and discriminating identifiable time-varying aspects of light output by one or more component light sources providing the mixed light. By discriminating properties of the component light sources, optical feedback can be facilitated.

In view of the foregoing, various embodiments and implementations of the present invention are directed to providing time-varying light outputs from two or more light sources providing mixed light in a lighting unit, the time-varying light outputs differing between light sources, and sensing and filtering the mixed light based on these time variations so as to measure aspects of light from each light source. For example, light from each light source can be modulated or pulsed at a different predetermined frequency, and filtering can comprise temporal filtering such as bandpass filtering, mixing/demodulation techniques such as homodyning, heterodyning, or lock-in filtering, and compensation operations. Different filtering operations can be applied to an optical signal indicative of sensed light to discriminate radiant flux or intensity of at least a portion of light from different light sources. Output of these filtering operations can be used to determine the intensity of light emitted from one or more component light sources due to driving the light sources with predetermined signals, which is useful for feedback control of the light source and by extension the lighting unit or lighting fixture.

In some embodiments of the present invention, certain operations, such as filtering and/or mixing, can result in losses in information about light from a light source. To compensate for such losses, embodiments of the present invention provide for recovery of information about the light source by combining results of the filtering and mixing with other properties indicative of light from a light source or the drive current thereof. For example, signals indicative of the duty cycle and/or amplitude of light from a PWM driven light source can be obtained from the light source drive current or optical sensor output, and these signals to combined with filtered signals partially indicative of intensity of light from the light source, to derive a compensated signal more representative of intensity of light from the light source.

Control of Light Sources

The present invention provides for control means for driving light sources contributing to a mixed light with time-varying drive signals. The drive signals are configured, using a control signal, to produce a desired lighting effect and can also be configured to have identifiable time-varying components. A modification signal can be used to configure the control signal at least in part, the modification signal for example being indicative of a selected modulation frequency and/or duty cycle of the control signal. Referring to FIG. 1, in one embodiment, the control signals for activation of the light sources correspond to switched waveforms such as pulse-width modulation (PWM) signals having a particular pulse frequency, wherein the frequency of the pulse-width modulation signal can be modified or selected by a signal received from a control system 199 such that the frequency is different for each color of light source. For example a frequency $f_1$ can be selected for the red light sources 135, a frequency $f_2$ can be selected for the green light sources 140, and a pulse frequency $f_n$ can be selected for the blue light sources 145.

For example, a control system 199, via a multi frequency generator 100, can generate independently different PWM control signals for transmission to light source modulators 105, 110 and 115, wherein these light source modulators transmit predetermined signals to the light source current drivers 120, 125 and 130 enabling activation of the light sources 135, 140 and 145 by supplying drive current thereto. The current drivers can be current regulators, switches or other similar devices as would be known to those skilled in the art. Power for control and driving of the light sources can be provided by a power supply 104.

In one embodiment, the PWM control signal is configured using an analog or digital modification signal, which is indicative of time-varying aspects such as the frequency and/or duty cycle of the drive current or PWM control signal. For example, the modification signal can itself be a waveform substantially similar to the PWM control signal or drive current, or another signal carrying information on how to generate such a drive current or a control signal indicative thereof.

In one embodiment, the frequency of a PWM or other pulsed signal is measured in Hertz (Hz), the number of times per second that the signal cycles or repeats. For example, for a PWM signal switching an on-value and an off-value, a portion of the PWM signal from the beginning of an on-value to the end of the subsequent off-value can be regarded as one cycle. The ratio of the time at which the PWM signal displays the on-value to the cycle time of the PWM signal can be regarded as the duty factor or duty cycle of the PWM signal. The duty factor or duty cycle can alternatively be regarded as a value between zero and one, proportional to the average value of the PWM signal. Switched waveforms having more than two levels, or having other temporal switching behaviors, can similarly be analyzed, for example using the principle of superposition or other techniques as would be understood by a worker skilled in the art.

In various embodiments of the present invention, the pulse frequencies for the PWM signals can be generated in firmware. For example, a high-frequency clock of the control system can be used wherein the output therefrom can be divided into a required number of lower frequency signals. This required number can be determined based on the number of different colors of light-emitting elements within the illumination system, the number of independently controlled arrays of light sources or other criteria as would be readily understood by a worker skilled in the art. Alternatively, pulse code modulation (PCM) or other pulse modulation methods readily known to skilled artisans, can be used instead of pulse width modulation.

In some embodiments of the present invention, the pulse frequencies used in operational control of the light sources are selected in order that none of the pulse frequencies are integral multiples of each other. For example, this may facilitate discrimination of light from different light sources in the filtering module by avoiding the occurrence of same-frequency harmonics from different light sources. The pulse frequencies which are used for the operational control of the light sources may be integral multiples of each other. In this case, discrimination of light from different light sources by the filtering module may require further processing, for example to compensate for harmonic contributions from different light sources during filtering and/or demodulation.

In one embodiment, a user interface (not illustrated) is operatively coupled to the controller to obtain the desired values of luminous flux output and chromaticity of the output light from a user of the system. In another embodiment, the illumination system can have the desired luminous flux output and chromaticity of the output light stored in memory thereof.

Those having skill in the art will recognize that the PWM control signals or PCM control signals generated by the controller can be implemented as computer software or firmware on a computer readable medium having instructions for determining the PWM control signal sequence.

As is known in the art, a time-varying signal such as a PWM, PCM or other signal can be represented by Fourier analysis as a superposition of sinusoidal signals, generally referred to as harmonics. In one embodiment, for a two-level PWM rectangular wave signal, the superposition can comprise a DC signal, a fundamental harmonic component, and higher order harmonics. The fundamental harmonic component can be represented by a sinusoidal signal having the same frequency as the PWM signal, and the higher order harmonics can be represented by sinusoidal signals having frequencies that are integer multiples of the fundamental frequency. Of the time-varying harmonics in a PWM signal, the fundamental harmonic component often has the highest amplitude. In addition, the relative amplitudes of the DC, fundamental harmonic and higher order harmonic components can vary with the duty cycle in a substantially predictable manner.

For example, a suitably time-shifted PWM signal or asymmetric pulse train having amplitude A, period $T_0$ and duty cycle $\tau$, can be represented by the time-varying equation:

$$x(t) = \begin{cases} A\prod\left(\frac{t}{T_0\tau}\right), & -T_0/2 < t < T_0/2 \\ x(t+T_0), & \forall\, t \end{cases} \tag{1}$$

where $\Pi(t)$ is a unit pulse function, having value 1 for $|t|<½$ and zero elsewhere. A Fourier series expansion of (1) yields the alternative representation:

$$x(t) = A\tau + \sum_{n=1}^{\infty} A_n \cos\left(\frac{2\pi n t}{T_0}\right), \text{ where } A_n = \frac{2A}{n\pi}\sin(n\pi\tau). \tag{2}$$

That is, the PWM signal can be represented by a superposition of a DC signal proportional to the duty cycle, and a series of sinusoidally varying harmonics of decreasing amplitudes at frequencies being integer multiples of the frequency of the PWM signal. The significance of representation (2) will become apparent herein with respect to filtering, mixing and compensation of a signal indicative of light emitted by light sources driven by a switched PWM waveform.

Light Sources

The light sources are adapted to generate radiation in the red, green, and blue region of the visible spectrum, respectively or may emit other colors of light as would be readily understood by a worker skilled in the art. In another embodiment of the present invention, light sources of other colors such as amber can also be used separately or in combination with the red light sources, green light sources and blue light sources. Optionally, the light sources can be mounted on separate heat sinks (not shown) for improved thermal management of the heat generated by the light sources in operation.

For a light source driven by a switched waveform such as a PWM drive current, it is contemplated that the light emitted by the light source may vary according to a substantially similar switched waveform, or the light may exhibit delayed or skewed responses to switching drive current, such as non-zero switching times, for example due to factors such as capacitance and inductance, as would be understood by a worker skilled in the art. Nonideal responses of the light sources can be accounted and compensated for in embodiments of the present invention. For example, electronic processing of the optical signal indicative of light from the light source can be performed to apply a signal transformation inverse to the combined transfer function of the current driver, light source, and optical sensor. Alternatively, filtering and compensation as disclosed herein can be adjusted as would be understood by a worker skilled in the art so as to be directly applicable in light of non-ideal responses of the light source, current driver, and/or optical sensor.

It is noted that the combination of colored light emitted by each of the red light sources, green light sources and blue light sources, or alternatively by other color combinations, can produce output light of a specific luminous flux and chromaticity, for instance white light, or any other color of light of the color gamut defined by the different colors of light sources.

In one embodiment, the illumination system includes mixing optics (not shown) to spatially homogenize the output light generated by mixing light from the red light sources, green light sources, blue light sources and optionally other color light sources.

Typically, as is understood in the art, pulse modulation methods such as PWM or PCM can be used to control the perceived intensity of light emitted by a light source, since fast variations in light emitted by a light source can be substantially imperceptible. Instead, an average intensity is typically perceived. Therefore, by increasing or decreasing the duty factor or duty cycle of a pulse modulated light source, the perceived intensity of the light source can be correspondingly increased or decreased.

Optical Sensor

The present invention provides for one or more optical sensors for providing an optical signal indicative of mixed light incident thereupon, for use in feedback control of the illumination system. The optical sensor 150 can be a phototransistor, a photosensor integrated circuit (IC), unenergized LED, a silicon photodiode with an optical filter, or the like. In one embodiment of the present invention, the optical sensor 150 is a silicon photodiode with an optical filter that has a substantially constant responsivity to spectral radiant flux within the visible spectrum. An advantage of using an optically filtered silicon photodiode is that this configuration does not require any multilayer interference filters. As a result, this format of optical sensor does not require substantially collimated light. In another embodiment of the present invention, the optical signal indicative of the radiant flux incident upon the optical sensor 150 can be electronically pre-processed with amplifier circuitry associated with the optical sensor or can be processed by analog or digital means in the controller 199.

Filtering Module

The present invention provides for one or more filtering modules, configured to discriminate and/or measure aspects of light emitted by component light sources represented by the optical signal. For example, the filtering module can be configured to measure radiant flux of each different color light source in a mixed light by processing of the optical signal indicative of the mixed light. Filtering and discriminating each color light source can be based on exploiting predetermined time-varying signatures of light emitted by each light source, for example due to their being driven by a PWM signal at a predetermined frequency.

Referring again to FIG. 1, in one embodiment, the output of the broadband optical sensor 150 is coupled to a signal processing module 198, configured to process the optical signal, which comprises a signal splitter module 160 for generating inputs for each of the filtering modules 180, 185 and 190. The filtering modules 180, 185 and 190 also accept as input versions of the control used in configuration of the drive currents, or of an associated modification signal, for example supplied by the controller 195. The outputs of the filtering modules 180, 185 and 190 are coupled to the controller 195, and represent values of the radiant flux output for each color of light source from the electronic filters 165, 170 and 175. Based on these values, the controller 195 can adjust the amounts of drive current for the red light sources 135, green light sources 140, and blue light sources 145 in order to maintain the luminous flux and chromaticity of the output light at desired levels.

Figure 2A:
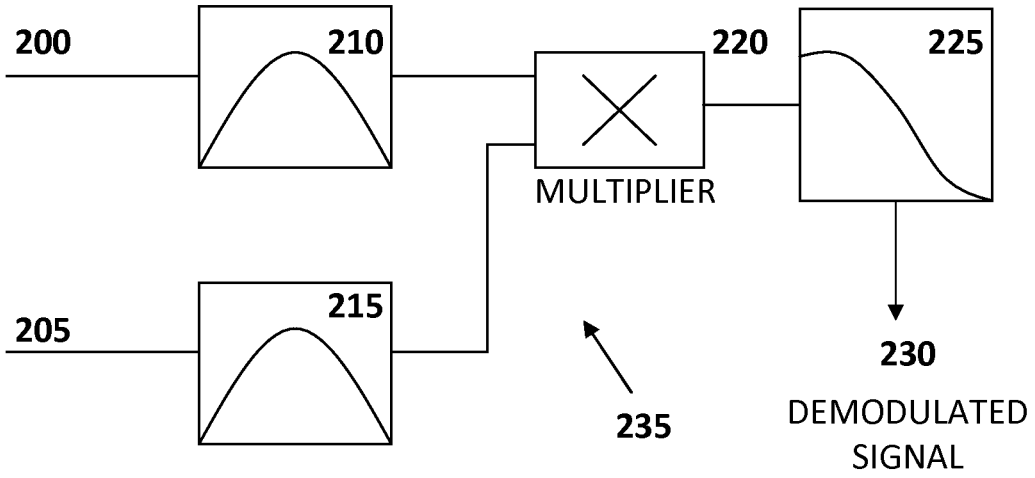
FIG. 2A is a block diagram of a filtering module according to one embodiment of the present invention.
Figure 2B:
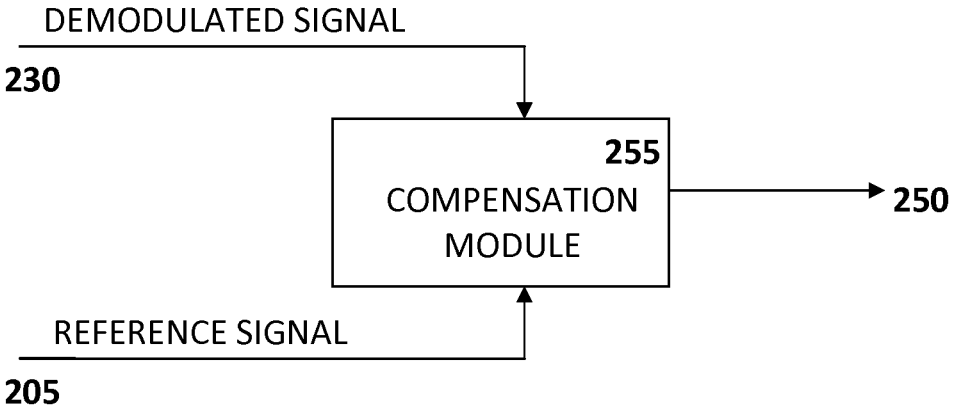
FIG. 2B is a block diagram of a compensation module according to one embodiment of the present invention.

In some embodiments, the filtering modules 180, 185 and 190 further comprise mixing modules 235 and/or compensation modules 255, as illustrated in FIGS. 2A and 2B. The mixing modules 235 can be configured to convert at least a portion of the received optical signal or other input 200, for example using frequency conversion, to facilitate analysis. The compensation modules 255 can be configured to provide corrections to signals 230 indicative of measured aspects of light, for example to compensate for information lost during filtering and/or mixing, thereby improving measurements supplied by the filtering modules. In some aspects of these embodiments, the mixing modules 235 and/or compensation modules 255 are configured to use signals provided by the controller to support their operation, such as a full or partial signal based on a control or modification signal. Such a full or partial signal can be configured as a reference signal 205.

In one embodiment of the present invention, at least a portion of a filtering module or mixing module 235 is configured as a homodyne receiver, heterodyne receiver, lock-in filter or the like, wherein an implementation of an appropriate receiver is provided for each color of light source being monitored, for example. An example of a homodyne receiver and a heterodyne receiver is illustrated in FIG. 2A. As would be known to a worker skilled in the art, the difference between these two receiver configurations is the selected frequency used for the reference signal. A heterodyne receiver has a reference signal which is different from the frequency of the received signal frequency and a homodyne receiver has a reference signal which has a frequency which is the same as the received signal frequency. A lock-in filter or receiver can be regarded as a homodyne receiver wherein the reference signal is a switched waveform such as a square wave signal, instead of a sinusoidal reference signal. Lock-in filters can be implemented straightforwardly in a digital manner as would be understood by a worker skilled in the art.

In one embodiment of the present invention, as illustrated in FIG. 2A, filtering and mixing can comprise the following. The received signal 200 indicative of mixed light is filtered by a bandpass filter 210 having a center frequency which is centered at or near the pulse frequency for the color of light source being monitored. Thus, the output of the bandpass filter 210 can be a filtered signal indicative of harmonics of the input signal near the pulse frequency. Filtering to select other harmonics is also possible. In addition, a reference signal 205 may be filtered by filter 215 if required. The filtering of the reference signal 205 can be dependent on the implementation of the type of filtering module, for example filtering may be required for a homodyne receiver, however, filtering of the reference signal 205 may not be required for a heterodyne receiver or a lock-in filter system. For example, filtering of the received signal 200 and the reference signal 205 can be provided in order to attenuate the harmonics and other interfering signals. The resulting filtered signals are mixed, which can substantially comprise multiplying the signals by a multiplier 220. In one aspect of the present embodiment, the resulting signal is subsequently filtered by low-pass filter 225, resulting in a filtered and converted signal 230 which is substantially indicative of the luminous flux output of the specific one or more light sources being evaluated.

Figure 3:
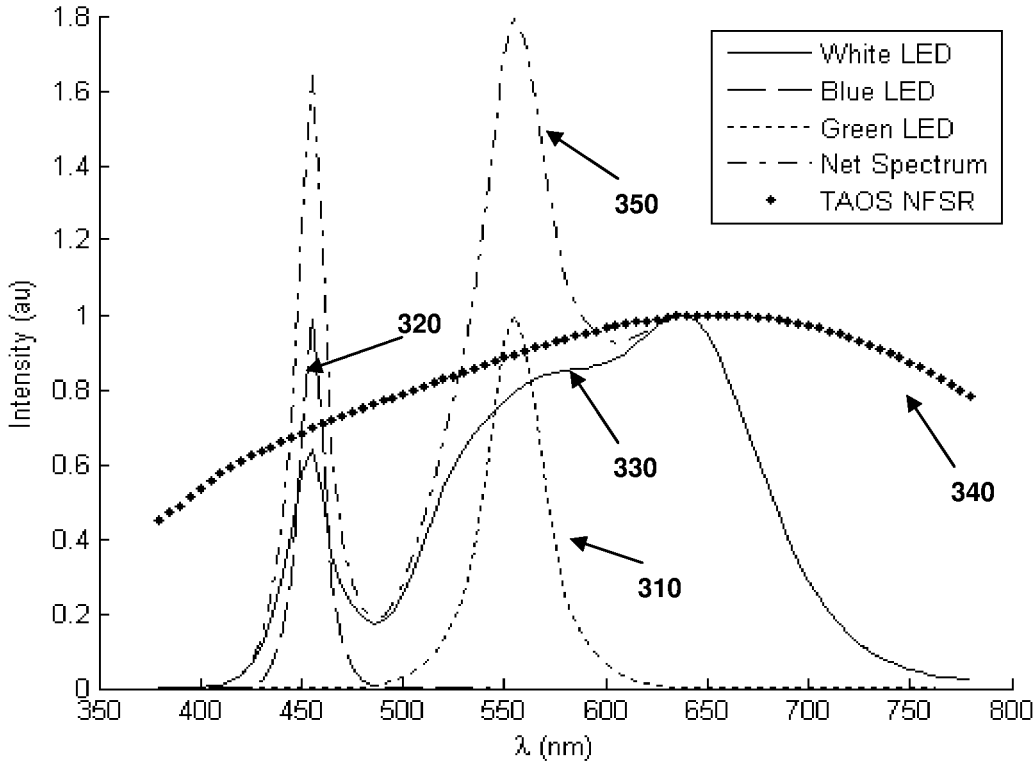
FIG. 3 illustrates a sample optical spectrum formed from green, blue and white LEDs together with a sample of a response curve for a broadband optical sensor.

For example, FIG. 3 illustrates a sample optical spectrum for an illumination system comprising green 310, blue 320 and white 330 light sources. Also illustrated in this figure is a sample response curve of a broadband optical sensor 340 and the net spectrum 350 of mixed green, blue and white light. The filtering module is configured to recover signals indicative of the spectra of the green, blue and white light sources from the mixed and sensed light thereof.

In one embodiment, aspects of light from a light source driven by a PWM, PCM or other signal can be measured by measuring aspects of the fundamental harmonic component and/or optionally one or more higher order harmonic components of the drive signal, or a related signal indicative of the light output of the light source. Measurement can be done by a combination of filtering activities, such as temporal filtering at frequencies of the order of drive signal frequencies or integer multiples thereof, mixing/demodulation, and compensation operations, such as described herein. Relationships between the measured components and the signal of interest can be used to recover information useful for feedback purposes. Moreover, by measuring only the selected fundamental harmonic and/or higher order harmonic components, interference from light sources not being measured can be substantially reduced.

Mixing

Mixing of a received signal, such as the optical signal or a filtered signal based thereon, involves processing the received signal using a reference signal, for example by multiplying the two signals or by equivalent digital or analog processing, as would be understood by a worker skilled in the art. Mixing can be represented by operation of a homodyne, heterodyne or other receiver or filter, as would be understood by a worker skilled to in the art. In one embodiment, the reference signals for each filtering or mixing module are obtained from the drive signals applied to the light sources, or alternatively from another source such as a light source modulator or controller. For example, the reference signals thus obtained can be substantial replicas of the PWM drive signals applied to the light sources. In some embodiments, by filtering these reference signals, a substantially sinusoidal signal can be obtained having the same frequency as the drive signal, suitable for demodulation. For example, the PWM drive signal can be filtered similarly to the received PWM signal using a bandpass filter to obtain a substantially sinusoidal signal at the PWM frequency having predetermined amplitude. In another embodiment, the reference signals are generated independently, having frequencies matched to the frequencies of the light source, for example as indicated by the controller or light source modulators. A local oscillator and/or phase-locked loop or other oscillating circuitry can be used to generate the reference signals.

Homodyne Receiver

The following is an example of the use of a filtering or mixing module configured as a homodyne receiver according to one embodiment of the present invention, which has been applied to the sample optical spectrum as illustrated in FIG. 3. In this configuration the illumination system comprises light sources which emit green light, blue light and white light.

Figure 4A:
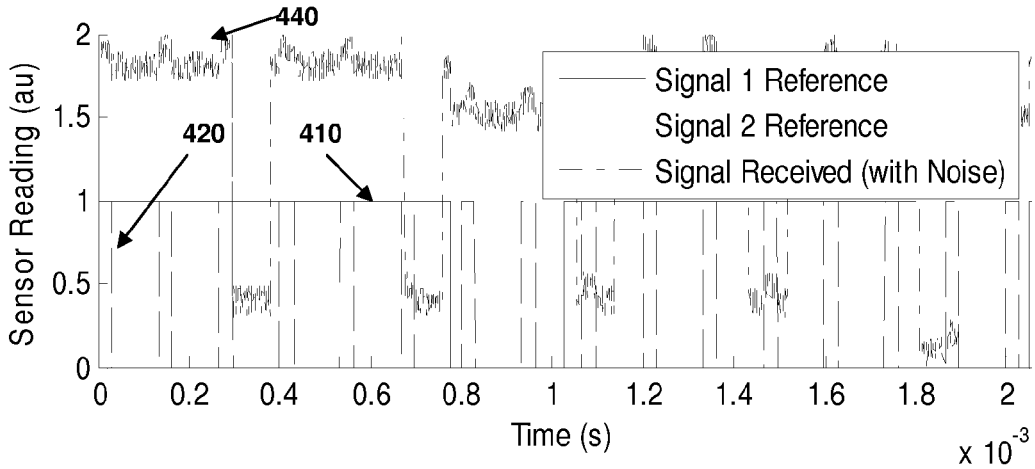
FIG. 4A illustrates pulse trains for multiple light sources together with a received signal from an optical sensor according to one embodiment of the present invention.
Figure 4B:
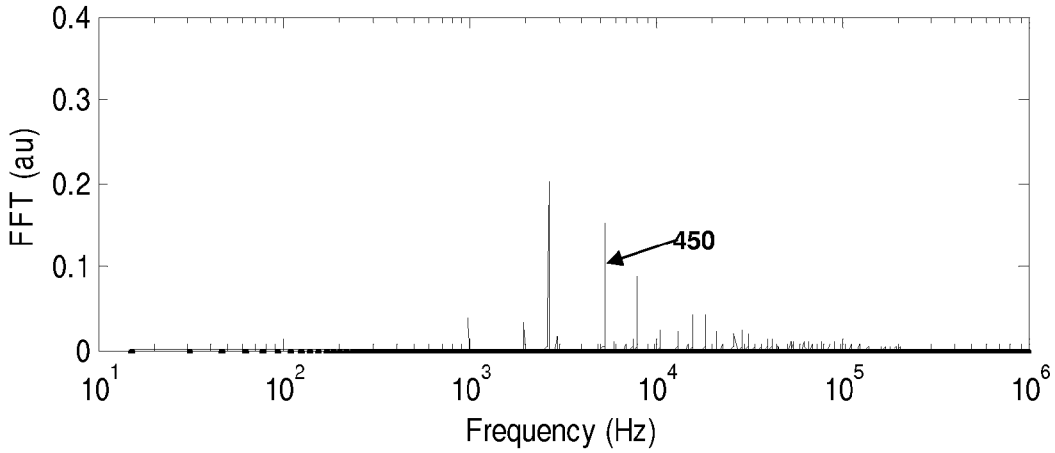
FIG. 4B illustrates a Fast Fourier Transform of the received signal illustrated in FIG. 4A.

One embodiment of the present invention is shown in FIGS. 4A and 4B. FIG. 4A illustrates the PWM pulse train for a green light source 410, the PWM pulse train for a blue light source 420 and the received signal 440. In this embodiment of the present invention, the received signal comprises noise, and the response generated by each of the light sources, namely the detected radiant or luminous flux output as received by the broadband optical sensor. Furthermore, FIG. 4B illustrates a Fast Fourier Transform 450 of the received signal illustrated in FIG. 4A.

Figure 5:
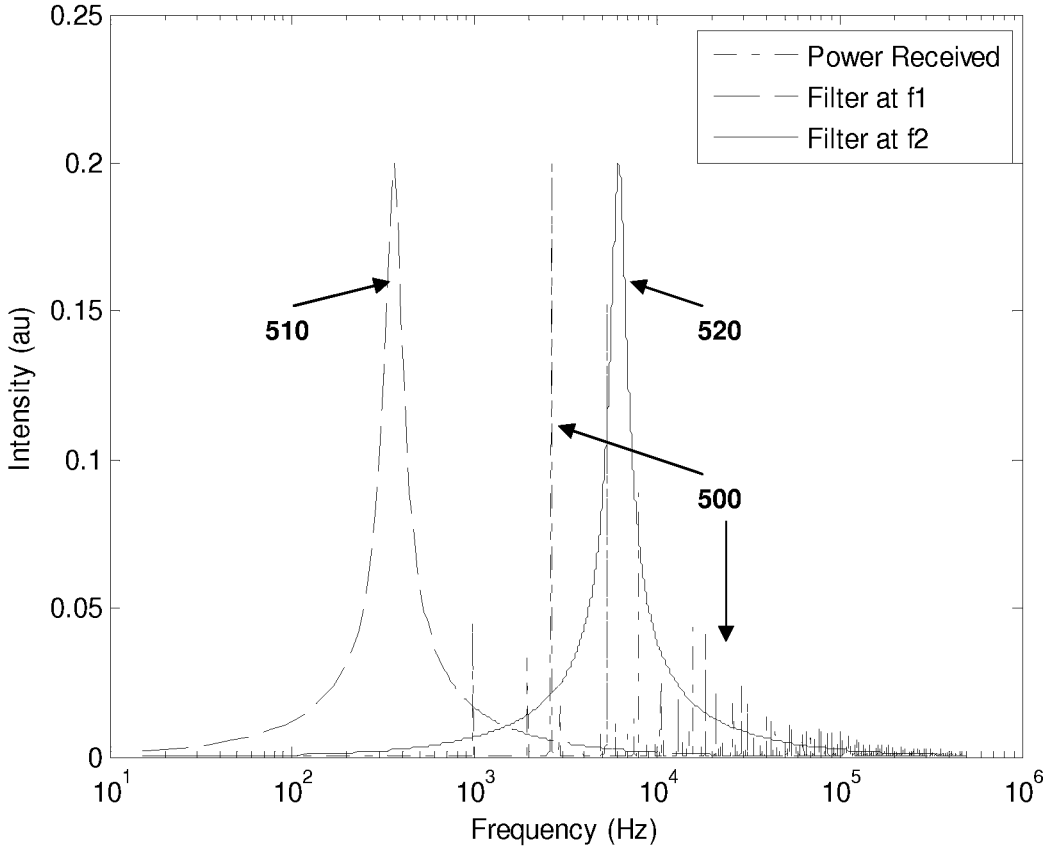
FIG. 5 illustrates the received signal from 4A in the frequency domain, together with bandpass filters selected for the filtering modules according to one embodiment of the present invention.
Figure 6:
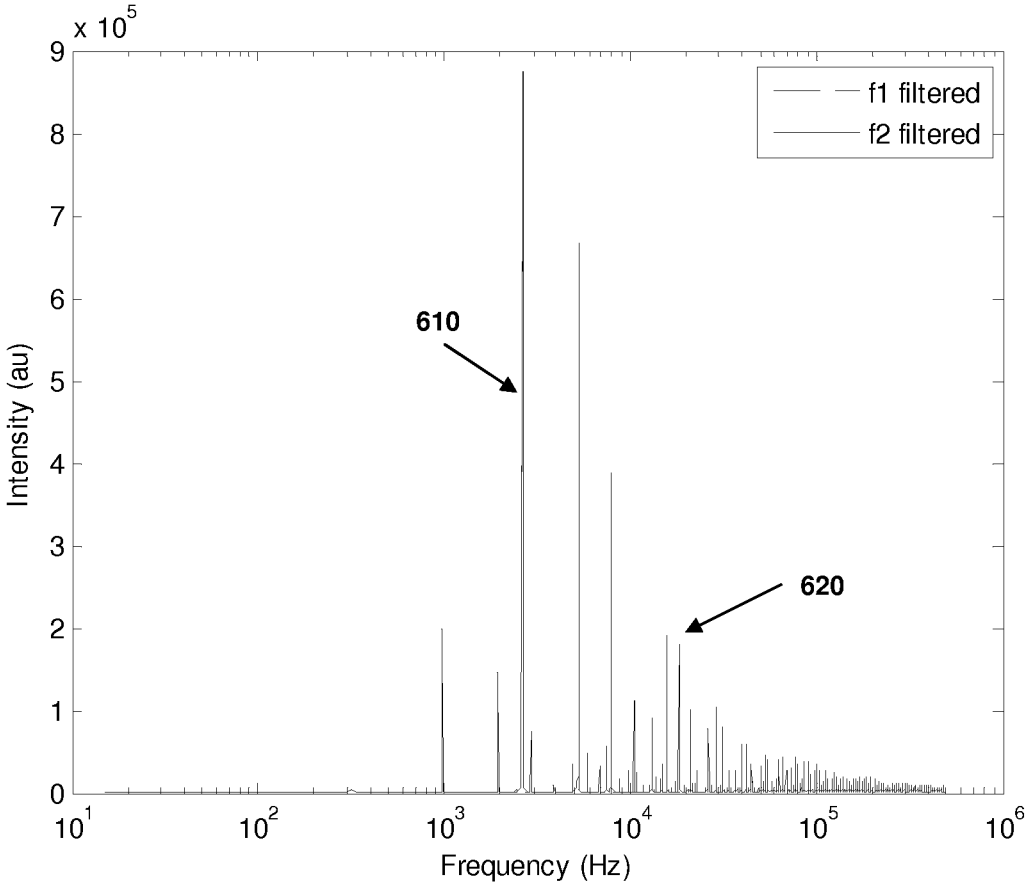
FIG. 6 illustrates the received signal from FIG. 5, after filtering using the bandpass filters according to one embodiment of the present invention.

In some embodiments of the present invention, the received signal is passed through a bandpass filter centered at the pulse frequency for that particular color of light source. FIG. 5 illustrates the spectra for the received signal 500 and two bandpass filters used to filter this received signal, a first bandpass filter spectrum 510 having a center frequency equal to $f_1$ and second bandpass filter spectrum 520 having a center frequency equal to $f_2$, wherein the frequencies $f_1$ and $f_2$ can be selected based on the drive frequency selected for the respective color of light source. In some embodiments, these bandpass filters can have a relatively low Q, or ratio of filter center frequency to filter full-width half maximum bandwidth, for example Q=5. FIG. 6 illustrates the received signal after is has been filtered by the bandpass filters illustrated in FIG. 5. The spectra of output of the first filter 610 and of output of the second filter 620 are shown.

In one embodiment of the present invention, as this is a homodyne receiver implementation, the reference signals multiplying the filtered received signals are based on the control or modification signals used in control of the different colors of light sources. For example, a reference signal can be indicative of a PWM drive current. The reference signals, each of which is to be associated with one of the above filtered received signals, can likewise be passed through bandpass filters having center frequencies $f_1$ and $f_2$.

For example, if a PWM signal, represented by x(t) in expressions (1) and (2) and having a PWM frequency $1/T_0$ substantially near $f_1$, is received and filtered by a bandpass filter having unity gain at center frequency $f_1$, then the output of the filter will include a substantially unattenuated component which can be represented by $y(t)=(2\ A/\pi)\sin(\pi\tau)\cos(2\pi f_0 t)$, possibly along with other attenuated signal components. The output corresponding to y(t) is then a substantially sinusoidal signal at the PWM frequency carrying information about the intensity of light emitted by the light source, encoded in the amplitude A and duty cycle $\tau$.

Figure 7:
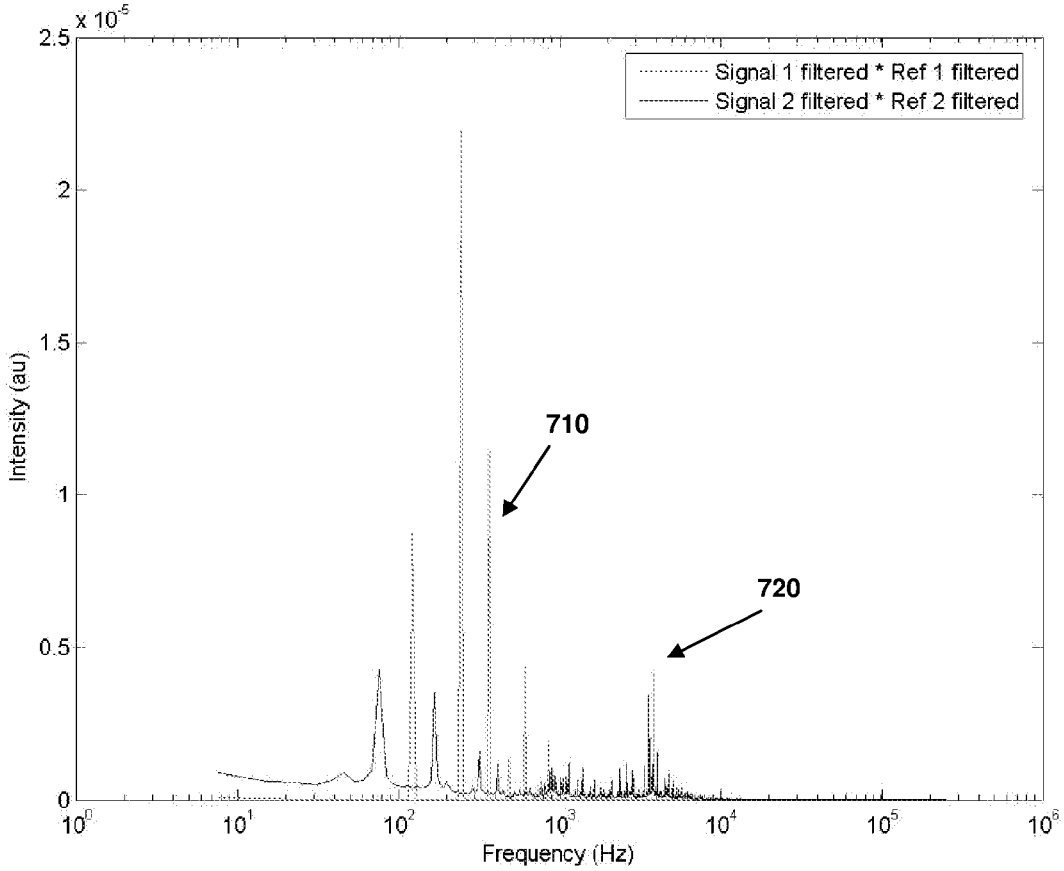
FIG. 7 illustrates the convolution of the filtered received signal with the filtered reference signals according to one embodiment of the present invention.

For homodyning, each of the filtered received signals for each color light are multiplied by the corresponding and optionally filtered reference signal. In one embodiment of the present invention, these signals are multiplied in the time domain. FIG. 7 illustrates the spectra of products of the first and second filtered reference signals with the corresponding first and second filtered received signals 610 and 620, to yield output signals 710 and 720, respectively. The two output signals 710, 720 have been scaled relative to each other for clarity. For example, FIG. 7 illustrates the convolution of the resulting multiplied signals as it is illustrated in the frequency domain.

Multiplication of a received signal with a reference signal having the same frequency results in an output having a substantially DC component with a value proportional to the product of the amplitudes of the two signals and affected by the phase between the two signals. This can be illustrated by the following representation of the product of two arbitrary sinusoids having the same frequency:

$$A_1\sin(\omega_1 t)A_2\sin(\omega_1 t+\phi)=\frac{A_1A_2}{2}\cos(\phi)+\frac{A_1A_2}{2}\cos(2\omega_1 t+\phi). \tag{3}$$

Figure 8:
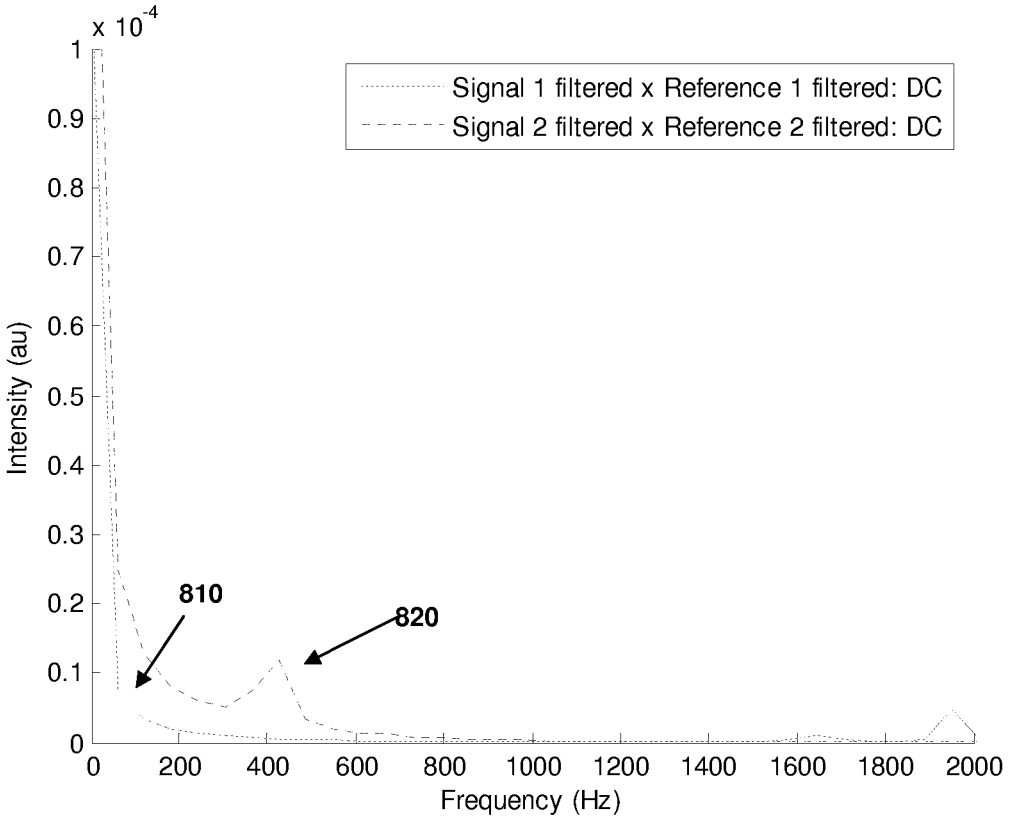
FIG. 8 illustrates the DC frequency components of the signals of FIG. 7.

In one embodiment of the present invention, by monitoring the DC component of the processed signal, which can be the product of the filtered received signal with the filtered reference signal, one can identify a change in the signal. Thus, for example, in Expression (3), if $A_1$ represents the amplitude of the filtered received signal, and $A_2$ and $\phi$ represent predetermined or measured amplitude and relative phase of the filtered reference signal, then the first term on the right-hand side of Expression (3) can be recovered by applying a low-pass filter to the processed signal and $A_1$ can be recovered given $A_2$ and $\phi$. For example as illustrated in FIG. 8, which illustrates the low frequency components 810 and 820 of the signals 710 and 720, respectively, illustrated in FIG. 7, one can monitor the DC components of the processed signal for the green light source and the blue light source. The values of these components can be proportional to the amplitude of the fundamental harmonic components of the received signals, and hence proportional to the intensity of light emitted by the light sources.

Heterodyne Receiver

According to another embodiment of the present invention, the filtering or mixing module is configured as a heterodyne receiver, wherein the reference signal used for this filtering technique is different from the frequency of the PWM signal with which it is being multiplied. As such the reference signal can be generated using an oscillator or other signal generating device as would be readily understood by a worker skilled in the art. In one embodiment, as this format of reference signal is being generated it may not require any filters prior to multiplication with the filtered received signal. Multiplication of the received signal by a reference signal can be a form of mixing or signal frequency conversion, and it is contemplated that other methods of mixing of conversion are applicable, as would be understood by a worker skilled in the art.

In one embodiment, multiplication of a received signal with a reference signal having a different frequency results in an output having a DC component with a value proportional to the product of the amplitudes $A_1$ and $A_2$ of the two signals and affected by the phase between the two signals. This can be illustrated by the following representation of the product of two arbitrary sinusoids having different frequencies $\omega_1$ and $\omega_2$ and phase shift $\phi$.

$$A_1\sin(\omega_1 t)A_2\sin(\omega_2 t+\phi)=\frac{A_1A_2}{2}(\cos((\omega_1+\omega_2)t+\phi)+\cos((\omega_1-\omega_2)t+\phi)). \tag{4}$$

In one embodiment of the present invention, the received signal is filtered and multiplied by a sinusoidal reference signal, and the result is filtered using a low-pass or bandpass filter to remove undesired components. This is analogous to removing the first term on the right-hand side of Expression (4). In aspects of the present embodiment, the output of the last filter typically oscillates at a lower frequency than the received signal. For example, in Expression (4), output frequency $(\omega_1-\omega_2)$ is lower, in some implementations, than received signal frequency $\omega_1$. This intermediate frequency signal can be easier to analyze, and contains information about the intensity of the light source, for example encoded in amplitude $A_1$.

Figure 13:
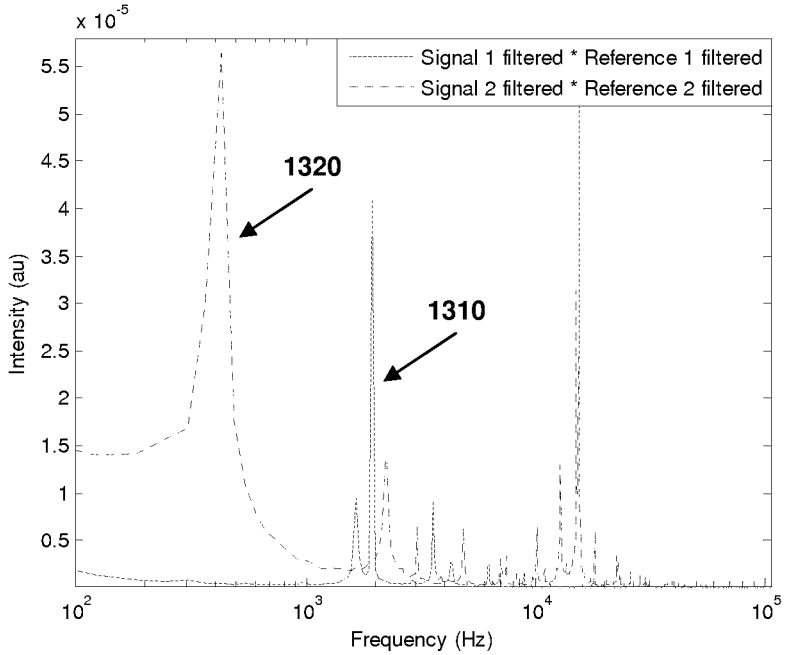
FIG. 13 illustrates the low frequency components of a heterodyne signal according to one embodiment of the present invention.

The remainder of the technique as applied to the homodyne receiver as defined above can be used for a filtering or mixing module which has been configured as a heterodyne receiver. For example a DC or time-varying signal can be monitored to detect variations in aspects of light emitted by a light source. For the example given above in relation to the homodyne receiver, FIG. 13 illustrates frequency components of the multiplied reference signal and the received signals for green light 1310 and blue light 1320 as determined from a heterodyne receiver according to one embodiment of the present invention.

Other Embodiments of Receivers or Filters

While the homodyne and heterodyne receivers and associated techniques described herein are cited as example means of filtering and discriminating light from different light sources, it is contemplated that other variations, additions and improvements of these techniques are useful. For example, many techniques for mixing or converting digital or analog signals are known in radio engineering and signal processing.

In one embodiment, the present invention comprises a superheterodyne receiver for discriminating light from different light sources. Typically, as is known in the art, a superheterodyne receiver can comprise at least two stages, wherein the received signal can first be filtered and down-converted to an intermediate frequency, which can then be further filtered and converted to a baseband frequency. Based on the operation of the homodyne and heterodyne receivers described above, a worker skilled in the art would understand how to implement the present invention using a superheterodyne receiver.

In one embodiment, the present invention comprises a lock-in filter or receiver for discriminating light from different light sources. A lock-in filter or receiver resembles a homodyne or heterodyne receiver wherein the reference signal is typically a rectangular wave or switched waveform signal, for example indicative of a control or modification signal associated with the light source being monitored. In addition, the lock-in filter may not require substantial filtering of the received signal if it is designed to accommodate PWM or PCM signals. Instead, the reference signal can act digitally, for example to switch on and off a signal inverter at switching times of the reference signal.

Optical Signal Compensation

In various embodiments of the present invention, filtering and/or mixing operations applied to the optical signal may potentially remove portions of the optical signal corresponding to a light source being monitored by a filter. For example, such filtering may occur in addition to removing undesired components of the optical signal such as components indicative of a different color light than the color which a filtering module is configured to discriminate, and indeed may be a side-effect of this process. As an example, a bandpass filter applied during mixing may remove some of the harmonics of an optical signal corresponding to a PWM driven light source. As removal of portions of the optical signal may result in a loss of information about light from the light source being monitored, the present invention can provide for optical signal compensation, such as performed via a compensation module, which can be configured to compensate for information loss in order to recover a more useful representation of aspects of a light source being monitored for feedback purposes.

In one embodiment, filtering and mixing can be configured to provide an output substantially indicative only of the amplitude of the fundamental harmonic component of a waveform indicative of output light from a selected light source. Therefore, a compensation operation can be configured to relate the provided output to the intensity of light from the light source of interest through a predetermined relationship, for example using the amplitude of the fundamental harmonic and information about the duty cycle of the light source output waveform to reconstruct a value proportional to the intensity of light from the light source. This reconstruction can be based on a modeled relationship between these three variables, such as that represented by the Fourier series amplitude coefficient of the fundamental harmonic component.

In another embodiment, filtering and mixing can be configured to provide an output indicative of the amplitudes of the fundamental harmonic component and one or more higher order harmonic components. A compensation operation can then relate this output to the intensity of light from the light source of interest. For example, amplitudes of several harmonics can be analyzed to derive a value proportional to the intensity of light by correlating these amplitudes with a predetermined model representing a class of waveforms indicative of output light of the light source, such as a class of PWM waveforms with different duty cycles. As an example, the absolute and/or relative amplitudes of two or more harmonics can be correlated to parameterized Fourier series amplitude coefficients of the harmonics of a PWM signal in order to determine a value indicative of intensity of light from the light source.

Figure 9:
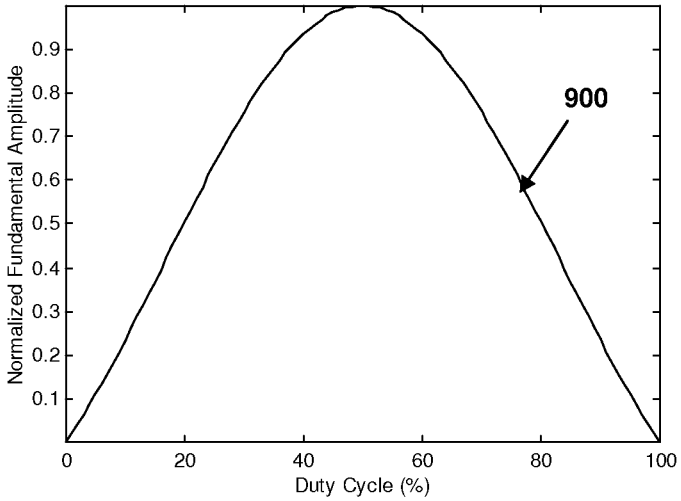
FIG. 9 illustrates the variation of the amplitude of the fundamental harmonic of a PWM wave according to one embodiment of the present invention.

In an exemplary embodiment, as the duty cycle of a PWM or other switched waveform changes from fifty percent, the relative amplitude of the harmonics in the PWM signal increase. At the same time however, the absolute amplitudes of these harmonics, which includes the fundamental frequency, decrease. Both of these phenomena can be seen in the dependence of $A_n$ on $\tau$ in Expression (2), that is:

$$|A_n| = \left|\frac{2A}{n\pi}\sin(n\pi\tau)\right|. \tag{5}$$

where $A_n$ is the amplitude of the $n^{th}$ harmonic, $\tau$ is the duty cycle and A is the amplitude of the PWM signal. For example, the relative amplitude 900 of the fundamental harmonic of a PWM signal with respect to the amplitude of the PWM signal, as the duty cycle is changed, is illustrated in FIG. 9.

In one embodiment of the present invention therefore, in order to compensate for variations in the amplitude of the fundamental harmonic and higher order harmonics with the duty cycle, the compensation module can multiply an input, for example indicative of amplitude of the fundamental harmonic, by a factor dependent on the duty cycle $\tau$, thereby deriving a signal indicative of intensity of light, for example from a light source driven by a PWM signal. The duty cycle can be obtained directly from the controller by analysis of a substantially PWM signal obtained from the reference signal or unfiltered or partially filtered optical signal, or by analysis of Fourier coefficients of harmonics of such a signal, for example. Apparatus for discerning a duty cycle from a substantially PWM signal can include comparators, edge triggers, or other digital and/or analog electronic devices as would be understood in the art.

In one embodiment, duty cycle compensation as described above comprises multiplying the demodulator output by the inverse of an amplitude given in Expression (5). For example, for the fundamental harmonic the inverse amplitude can be expressed substantially as follows:

$$A_1^{-1} = \frac{\pi}{2A\sin(\pi\tau)}. \quad (6)$$

Figure 10:
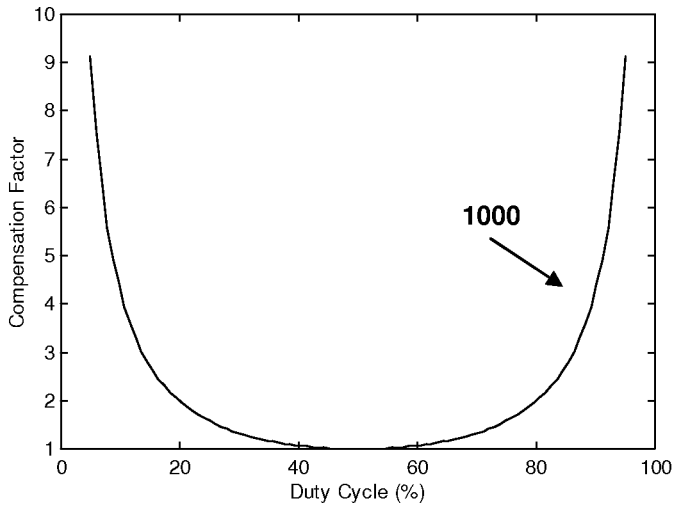
FIG. 10 illustrates the PWM duty cycle compensation factor according to one embodiment of the present invention.

In one embodiment of the present invention, the duty cycle compensation factor 1000 is illustrated in FIG. 10, and has been plotted over a range of five to ninety five percent duty cycles. In certain embodiments, the duty cycle is not extended beyond this range, to avoid potential processing problems as the received signal amplitude becoming progressively smaller.

Figure 11:
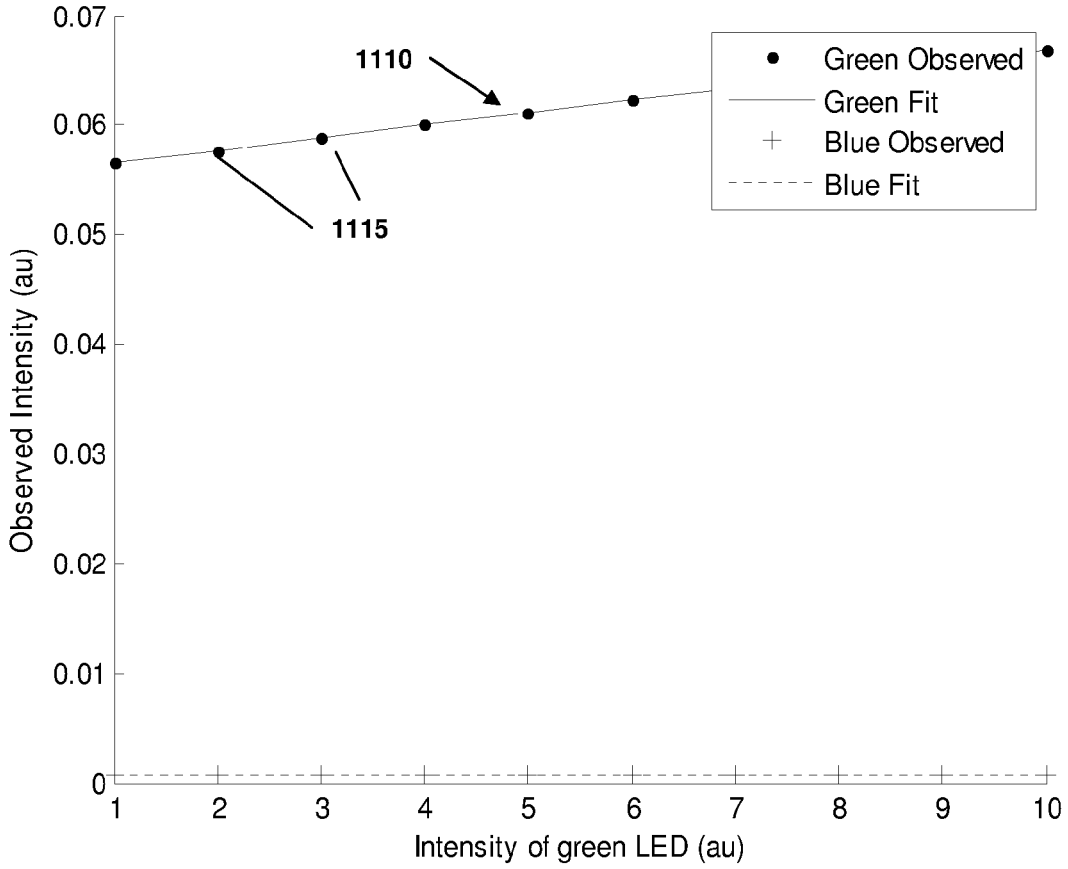
FIG. 11 illustrates the effect of changing the intensity of the green light sources, while holding the emission of the blue light sources constant, according to one embodiment of the present invention.
Figure 12:
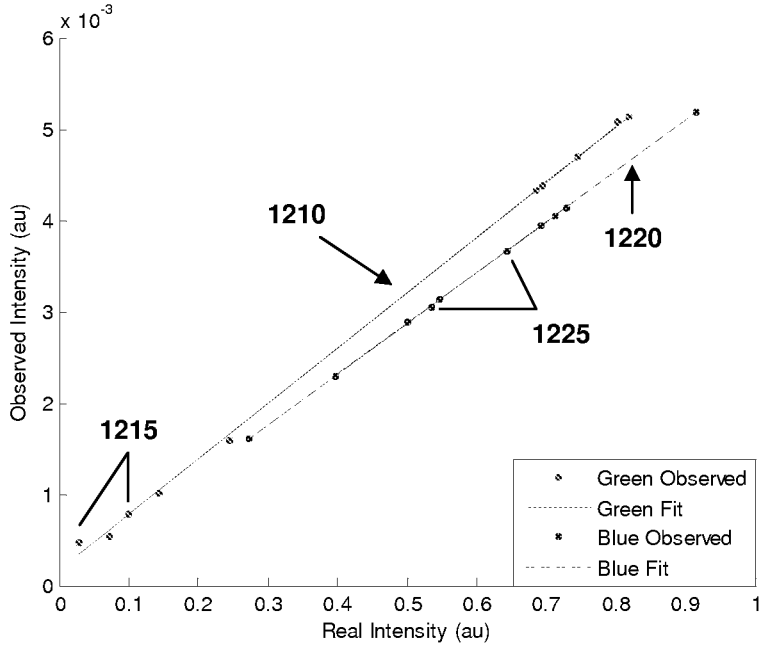
FIG. 12 illustrates a comparison between the actual and the detected intensities of the light sources according to one embodiment of the present invention.

In one embodiment of the present invention, compensation can comprise correlating an observed intensity of light to a true intensity of light using a calibration curve, function, look-up table or equivalent method. For example, FIG. 11 illustrates a substantially linear correlation between observed and actual intensity of signal 1, for example indicative of intensity of green light sources, while holding signal 2 constant, for example indicative of blue light sources. As illustrated this changing intensity can be represented by a substantially straight line 1110, which defines this calibration curve, as fitted to observed data points 1115. In other embodiments of the present invention, the calibration curve can be defined using a quadratic, or other polynomial, exponential, asymptotic, sinusoidal, or other analytic or non-analytic function. As another example, FIG. 12 illustrates correlation curves between the actual and detected intensity of the green light 1210 and blue light 1220 as emitted by embodiments of the illumination system, for example as fitted to observed data 1215 for green light, and 1225 for blue light.

In one embodiment, information derived for a first light source can be used in compensation operations applied for a second light source. For example, harmonics in the optical signal due to a PWM waveform for a first light source can be predicted by analysis of one or more harmonics as described above, and contributions from these predicted harmonics can be removed in analysis of the second light source, for example by subtracting any interfering harmonics from signals indicative of the second light source. Parallel, interdependent compensation of multiple light sources can also be performed in this manner.

Methods for Providing Drive Current

In embodiments of the present invention, alternate techniques for providing the drive current or associated control or modification signals for each color of light source are used which can enable the distinguishing of the luminous flux output from each color of light source using a broadband sensor.

In one embodiment of the present invention, a common switched waveform signal such as a PWM or PCM signal can be modulated in generating different current drive signals for different light sources. For example, a common PWM or PCM signal can be generated, the duty cycle or pulse density factor of which is differently modulated for each light source, resulting in driving each light source at a different frequency which can be discriminated via filtering. In one version of this embodiment, the duty factor of a common PWM signal, having a pulse frequency n for example between 30 kHz and 100 kHz, is modulated at a lower frequency m, for example around 100 Hz to avoid noticeable flicker, where m is different for each light source. The modulation can comprise increasing the duty factor of the PWM signal by a predetermined amount every 1/m seconds. For example, the predetermined amount can be dictated by a binary value. A bandpass filter having center frequency m can then be used in the processing module to discriminate light generated according to the modulated PWM signal. Mixing and compensation can also be performed on the modulated signal as described herein.

The frequency modulation scheme described in the example above results in the common PWM signal being modulated with a square wave. In another example of this embodiment, modulation of the common PWM signal can be performed by generating a series of modulation waveforms, and periodically increasing the duty factor at selected switching points of each of the series of waveforms. Moreover, to reduce harmonic content of the modulation signal, the modulation waveforms can be selected such that their superposition approximates a sine wave.

A suitable approximation to a sine wave can be achieved by utilizing two or more Walsh functions, for example as described in Photodetection and Measurement: Maximizing Performance in Optical Systems by Mark Johnson, Section 5.6, Walsh Demodulators. As would be known to a worker skilled in the art, Walsh functions are two-parameter functions that form an orthogonal series. These functions can be used similar to sine and cosine series for Fourier analysis and synthesis to construct approximations of other functions. In addition, as Walsh functions are inherently digital, they can be efficient at approximating functions containing steps. A possible advantage of this solution is that multiple driver channels can use a common clock to provide the PWM or PCM drive signal, thereby reducing component cost.

In another embodiment of the present invention, the PWM or PCM drive signal can be further modulated using other known modulation techniques, including but not limited to amplitude modulation (AM), frequency modulation (FM), single sideband modulation (SSB), phase modulation (PM), quadrature amplitude modulation (QAM), amplitude shift keying (ASK), frequency shift keying (FSK), continuous phase modulation (CPM), trellis coded modulation (TCM), orthogonal frequency-division modulation (OFDM), time-division multiplexing (TDM), code division multiple access (CDMA), carrier sense multiple access (CSMA), frequency hopping spread spectrum (FHSS), and direct-sequence spread spectrum (DSSS) techniques.

In another embodiment of the present invention, one can reduce the known sensitivity that mixers such as lock-in amplifiers have to the phase difference between the input and reference signals, for example as part of compensation. Sensitivity reduction can include, for example, synchronizing the reference signal with the received signal or optical signal by means of a phase-locked loop. If the received signal is a PWM or PCM signal, sensitivity reduction can be implemented by synchronizing the reference signal with the rising edge of the received signal. The aforementioned frequency modulation then becomes differential pulse position modulation. A potential advantage of this approach is that light from a light source can be discriminated by one or more signal processing modules without the need for electrical connections to derive a reference signal from the drive controller modification signal, for example. By locking onto different predetermined frequencies, a single lock-in amplifier can therefore be used to monitor outputs of multiple light sources or lighting fixtures (e.g., luminaires) in a networked lighting system.

Example Method for Generating and Discriminating Mixed Light

Figure 14:
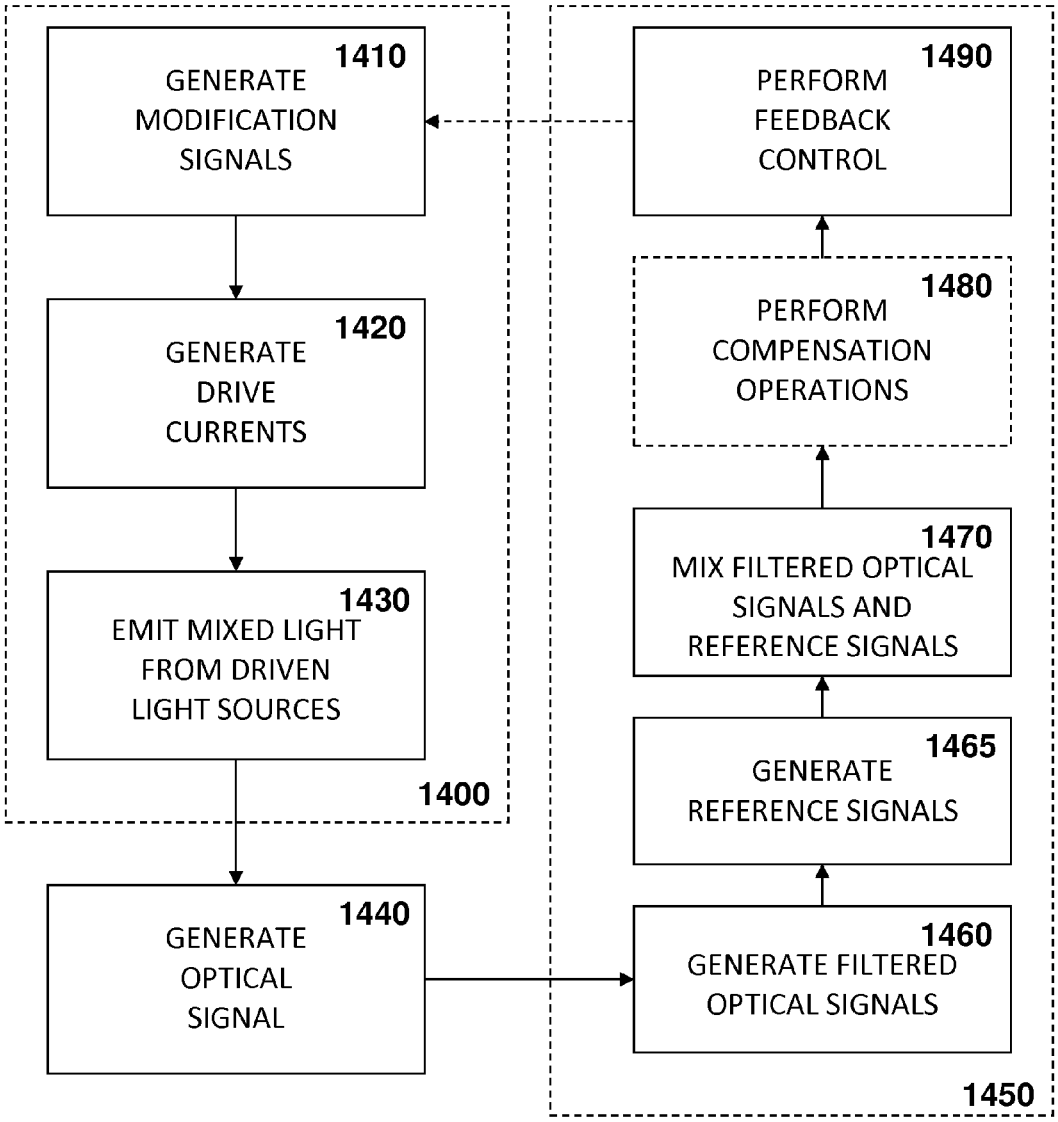
FIG. 14 illustrates a method for generating a desired output light according to one embodiment of the present invention.

FIG. 14 illustrates a method for generating and discriminating mixed light according to an exemplary embodiment of the present invention. As illustrated, modification signals used for generating and/or configuring drive current control signals are generated for each array of one or more light sources in step 1410, and the drive currents are subsequently generated in step 1420. For example, the modification signals can specify PWM drive currents having a particular amplitude, frequency and/or duty cycle. Light sources are driven by their respective drive currents, and emitted light is mixed in step 1430. The above steps can be represented as an overall step 1400 for generation of mixed light.

Continuing with reference to FIG. 14, an optical signal indicative of mixed light is generated in step 1440, for example by using an optical sensor. The optical signal is used as input to a processing step generally described as a step 1450, which can comprise the following steps. In optional step 1460, the optical signal is replicated and filtered, for example using one or more bandpass filters, each centered at a frequency configured to favour passing components of the optical signal indicative of light from a selected light source. In addition, in step 1465, reference signals corresponding to each array of one or more light sources for which light is to be discriminated can be generated or derived. For example, the reference signals can be filtered or unfiltered versions of the modification signals, control signals or signals based thereon, or can be locally generated, depending on the mixing approach to be used. In step 1470, filtered or unfiltered optical signals are mixed with the reference signals, using for example homodyne, heterodyne or lock-in filter techniques. Mixing is performed between filtered optical signals and reference signals both corresponding to a selected array of one or more light sources. In optional step 1480, compensation operations can be performed on results of the mixing operations, to compensate for any information lost during filtering and/or mixing. For example, if a mixing operation generates an indication of intensity of light due to a bandlimited portion of light from a light source, the compensation operation can combine this indication with other information, such as the drive current duty cycle, to generate an indication of intensity of light substantially without bandwidth limitations. Finally, in step 1490, feedback control is performed based on the processed and optionally compensated signals indicative of light, for example comparing indications of light with desired qualities of the light, and adjusting the modification signals and/or drive currents if required.

At least portions of the above method or similar methods can optionally be provided using a computer program product, such as can be stored on a computer readable medium, for example a magnetic or optical disc, RAM, ROM, signal, or other medium. As would be understood by a worker skilled in the art, a processor can read statements of the computer program product and operate means for performing the method in accordance with such statements.

While aspects of the present invention have presented signal processing based on Fourier analysis techniques, it is contemplated that similar signal processing techniques, such as those based on cosine transforms, wavelet transforms, and other methods of analysis, can also be applied to achieve similar results according to embodiments of the present invention. A worker skilled in the art would understand how to implement such signal processing based on the present disclosure.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

The invention claimed is:

1. An illumination device for generating light having a desired luminous flux and chromaticity, the illumination device comprising:

(a) one or more first light sources adapted to generate a first light having a first spectral power distribution, and one or more second light sources adapted to generate a second light having a second spectral power distribution different than the first spectral power distribution;

(b) a first current driver operatively coupled to the one or more first light sources, the first current driver configured to selectively supply electrical drive current to the one or more first light sources based on a first control signal, and a second current driver operatively coupled to the one or more second light sources, the second current driver configured to selectively supply electrical drive current to the one or more second light sources based on a second control signal;

(c) an optical sensor for sensing a portion of an output light which includes a combination of the first light and second light, the optical sensor configured to generate an optical signal indicative of radiant flux of the output light;

(d) a processing module operatively coupled with the optical sensor and receiving the optical signal therefrom, the processing module comprising:

(i) a first filtering module including a first mixing module, the first mixing module configured to perform mixing of a first filtered signal indicative of a first portion of the optical signal using a first reference signal, the first filtering module thereby providing a first output signal indicative of a characteristic of a portion of the first light;

(ii) a second filtering module including a second mixing module, the second mixing module configured to perform mixing of a second filtered signal indicative of a second portion of the optical signal using a second reference signal, the second filtering module thereby providing a second output signal indicative of a characteristic of a portion of the second light; and (e) a controller operatively coupled with the first current driver, second current driver, and the processing module, the controller being configured to generate the first control signal and second control signal based at least in part on the respective first output signal and the second output signal, said first control signal and second control signal being configured using a first modification signal and second modification signal, respectively, the first modification signal being indicative of time-varying aspects of the drive current for the first light source and/or first control signal, and the second modification signal being indicative of time-varying aspects of the drive current for the second light source and/or second control signal, wherein the first filtering module further includes a first compensation module configured to provide the first output signal based at least on output of the first mixing module and the first modification signal.

2. The illumination device of claim 1, wherein the first reference signal is based on the first modification signal.

3. The illumination device of claim 1, wherein the first control signal is indicative of a PWM signal having a first frequency and a first duty cycle.

4. The illumination device of claim 3, wherein the first modification signal is indicative of at least the first frequency and first duty cycle, the first filtered signal is indicative of a portion of the first light corresponding to a harmonic of the PWM signal, and the first compensation module is configured to provide the first output signal based on at least the PWM duty cycle.

5. The illumination device of claim 3, wherein the second control signal is a second PWM signal having a second frequency different from the first frequency.

6. The illumination device of claim 5, wherein the ratio of the higher of the first frequency and second frequency to the lower of the first frequency and second frequency is substantially between two integers.

7. The illumination device of claim 1, further comprising mixing optics for mixing light from at least the one or more first light sources and the one or more second light sources.

8. The illumination device of claim 1, wherein the first mixing module is configured as a homodyne receiver and the reference signal is a filtered switched waveform signal at least partially based on the first modification signal.

9. The illumination device of claim 1, wherein the first mixing module is configured as a heterodyne receiver.

10. The illumination device of claim 1, wherein the first mixing module is configured as a lock-in filter, and the reference signal is a switched waveform signal based on the first modification signal.

11. The illumination device of claim 1, further comprising a bandpass filter, wherein the first filtered signal indicative of a first portion of the optical signal is obtained by passing the optical signal through the bandpass filter.

12. The illumination device of claim 1, further comprising a clock having a clock signal, wherein the first control signal is derived from the clock signal.

13. A method for generating output light of a desired luminous flux and chromaticity, the method comprising the steps of:

(a) generating a first drive current for one or more first light sources using a first modification signal indicative of time-varying aspects of the first drive current;

(b) generating a second drive current for one or more second light sources using a second modification signal indicative of time-varying aspects of the second drive current;

(c) generating an optical signal indicative of output light characteristics, the output light being a mixture of light emitted by the one or more first light sources and one or more second light sources;

(d) processing a first filtered signal indicative of a first portion of the optical signal including performing a first mixing operation based on a first reference signal, thereby providing a first measurement indicative of radiant flux of light emitted by the one or more first light sources; and (e) processing a second filtered signal indicative of a second portion of the optical signal including performing a second mixing operation based on a second reference signal, thereby providing a second measurement indicative of radiant flux of light emitted by the one or more second light sources, wherein processing the first filtered signal indicative of the first portion of the optical signal further includes performing a first compensation operation based on the first modification signal.

14. The method of claim 13, further comprising adjusting the first drive current and/or the second drive current.

15. The method of claim 13, wherein processing the first portion of the optical signal further comprises performing a first compensation operation based on the first modification signal.

16. The method of claim 13, wherein the first reference signal is at least partially based on the first modification signal.

17. The method of claim 13, wherein the first drive current is a PWM signal having a first frequency and a first duty cycle, wherein the first modification signal is indicative of at least the first frequency and first duty cycle, the first portion of the optical signal is indicative of radiant flux of light emitted by the one or more first light sources in accordance with a harmonic of the PWM signal, and wherein the first compensation operation is performed based on at least the PWM duty cycle, in accordance with a Fourier coefficient of the harmonic of the PWM signal.

18. The method of claim 13, wherein the second drive current is a PWM signal having a second frequency different from the first frequency.

19. The method of claim 18, wherein the ratio of the higher of the first frequency and second frequency to the lower of the first frequency and second frequency is substantially between two integers.

20. A computer program product comprising a computer readable medium having recorded thereon statements and instructions for execution by a processor to carry out a method for generating output light of a desired luminous flux and chromaticity, the method comprising the steps of:

(a) generating a first drive current for one or more first light sources using a first modification signal indicative of time-varying aspects of the first drive current;

(b) generating a second drive current for one or more second light sources using a second modification signal indicative of time-varying aspects of the second drive current;

(c) generating an optical signal indicative of output light characteristics, the output light being a mixture of light emitted by the one or more first light sources and one or more second light sources;

(d) processing a first filtered signal indicative of a first portion of the optical signal including performing a first mixed operation based on a first reference signal, thereby providing a first measurement indicative of radiant flux of light emitted by the one or more first light sources;

(e) processing a second filtered signal indicative of a second portion of the optical signal including performing a second mixing operation based on a second reference signal, thereby providing a second measurement indicative of radiant flux of light emitted by the one or more second light sources, wherein processing the first filtered signal indicative of the first portion of the optical signal further comprises performing a first compensation operation based on the first modification signal.

* * * * *